United States Patent [19]

Tosswill

[11] Patent Number: 4,636,629

[45] Date of Patent: Jan. 13, 1987

[54] IMAGE-STORAGE MICROCHANNEL DEVICE WITH GATING MEANS FOR SELECTIVE ION FEEDBACK

[75] Inventor: Christopher H. Tosswill, Sturbridge, Mass.

[73] Assignee: Galileo Electro-Optics Corp., Sturbridge, Mass.

[21] Appl. No.: 718,954

[22] Filed: Apr. 2, 1985

[51] Int. Cl.[4] ..... H01J 31/50

[52] U.S. Cl. ..... 250/213 VT; 313/103 CM

[58] Field of Search ..... 250/207, 213 VT; 313/103 CM, 105 CM, 535

[56] References Cited

U.S. PATENT DOCUMENTS

| | | | |
|---|---|---|---|
| 3,374,380 | 3/1968 | Goodrich | 313/104 |
| 3,825,922 | 7/1974 | Ralph | 313/105 CM |
| 4,024,390 | 5/1977 | Bosserman et al. | 250/207 |
| 4,182,969 | 1/1980 | Catanese et al. | 313/105 R |

*Primary Examiner*—David C. Nelms
*Assistant Examiner*—L. W. Madoo

[57] ABSTRACT

There is provided a device which will provide a trace or image or will store a trace or image. One microchannel plate in series with another selectively multiplies into the latter, which provides feedback into the former, selectively as permitted by suitable gates.

10 Claims, 10 Drawing Figures

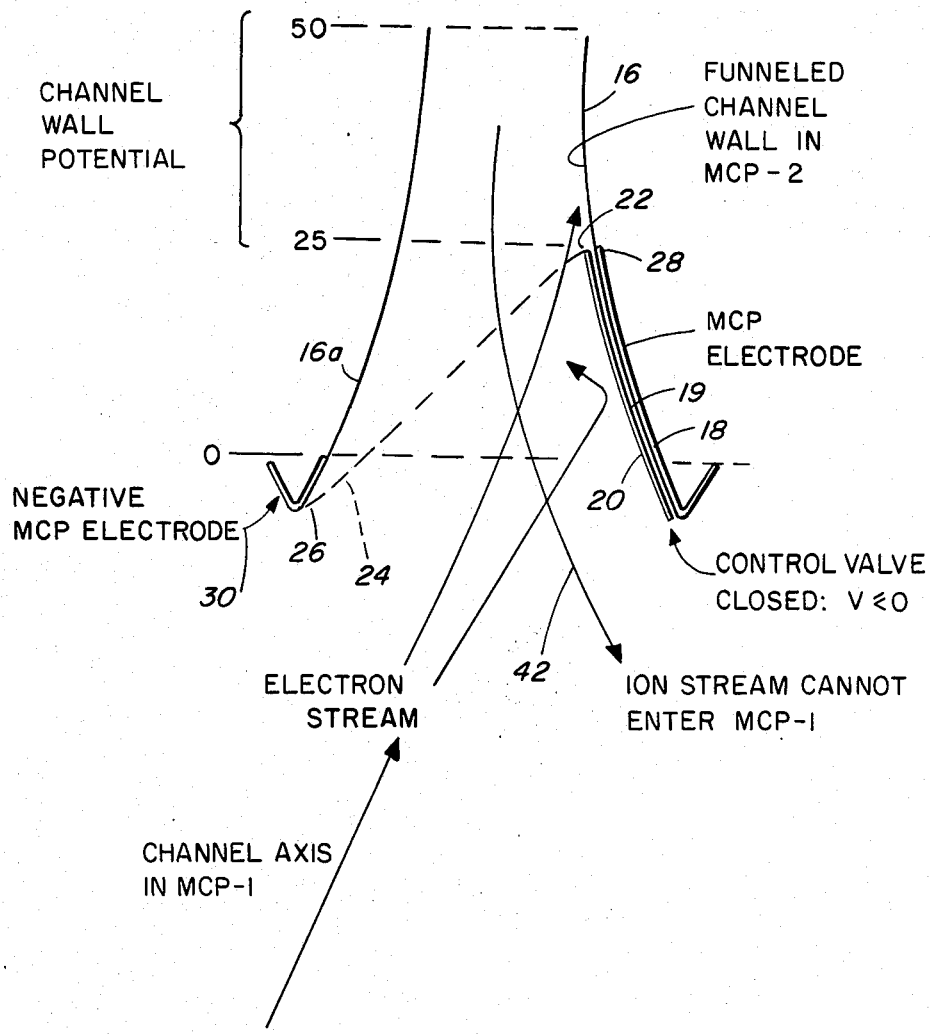
FIG. 3(a): VALVE CLOSED
CONTROL VALVE SURFACE POTENTIAL < 0

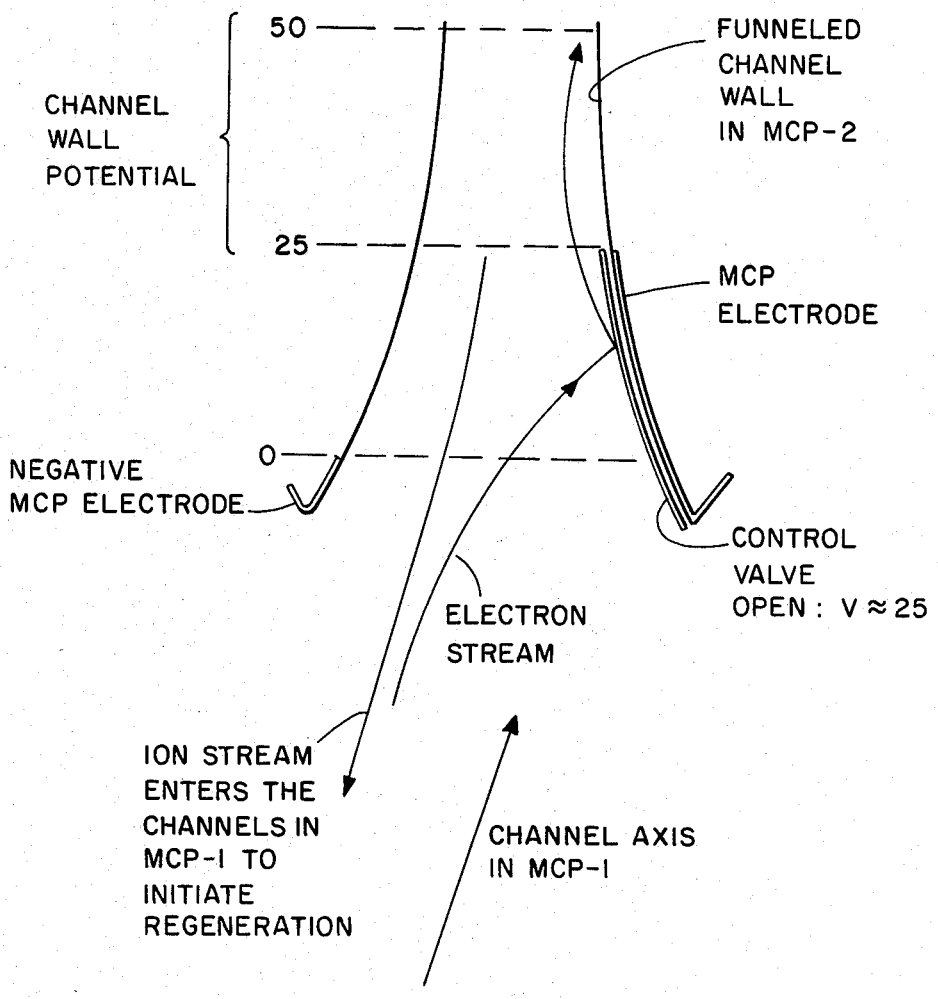
*FIG. 3(b)*: VALVE OPEN
CONTROL VALVE SURFACE POTENTIAL ≈ 25

IMAGE-STORAGE MICROCHANNEL DEVICE WITH GATING MEANS FOR SELECTIVE ION FEEDBACK

FIELD OF THE INVENTION

The invention relates to microchannel plate devices, and particularly to such devices in which a trace or image is produced.

BACKGROUND OF THE INVENTION

Multi-channel electron multipliers, now often called micro-channel plates ("MCP"'s), are well known in the art; so are pairs of such devices arranged with their channels oriented in directions not parallel; such a device is disclosed in Goodrich U.S. Pat. No. 3,373,380, "Apparatus for Suppression of Ion Feedback in Electron Multipliers", issued Mar. 19, 1968. Also, it has been known for some years to flare the inlets of the downstream plate channels, as done in the preferred embodiment disclosed hereinbelow. It has been known also to use the output of an MCP to produce a trace ("write") on a phosphor screen.

SUMMARY OF THE INVENTION

I have discovered that both writing with MCP output and selectively holding the writing may be accomplished by providing a pair of MCP's in series, the pair being provided with means to cause regenerative operation with ion feedback from one MCP to the other and means to selectively cause or prevent such feedback.

In preferred embodiments, the MCP's have channel axes along non-parallel lines, gating of ion feedback is by small control electrodes around mouths of channels of the MCP mainly receiving electrons and selectively feeding back positive ions to the other, and the control electrodes are spaced from MCP electrodes by a thin layer of insulating, rectifying material.

PREFERRED EMBODIMENT

Follow are drawings with respect to a preferred embodiment, and a description of its structure and operation.

DRAWINGS

FIG. 1(*a*) is an enlarged view of an indicated portion of FIG. 1.

FIG. 1(*b*) is an enlarged view of an indicated portion of FIG. 1(*a*).

FIG. 3(*a*) is a diagrammatic view of a portion of the invention in certain modes of operation.

FIG. 3(*b*) is a similar view with respect to yet another mode.

Figure 4:
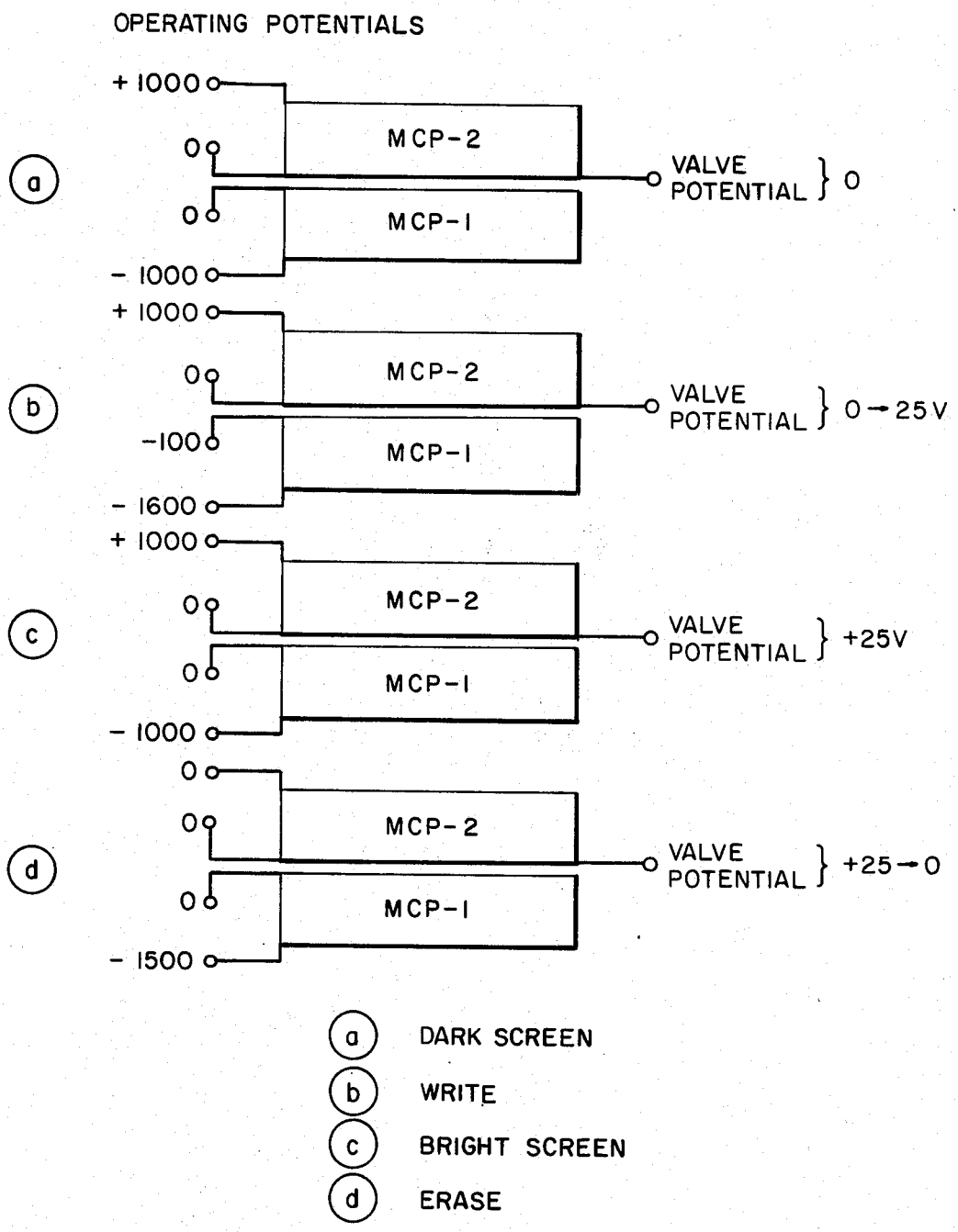

FIG. 4(*a*), 4(*b*), 4(*c*) and 4(*d*) are diagrammatic drawings of voltages applied in various modes.

STRUCTURE

Figure 1:
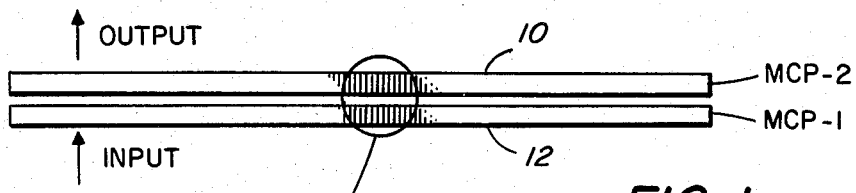
FIG. 1 is a diagrammatic view of a pair of microchannel plates.
Figure 1A:
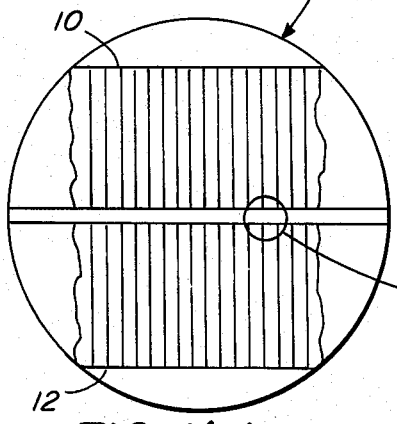
Figure 1B:
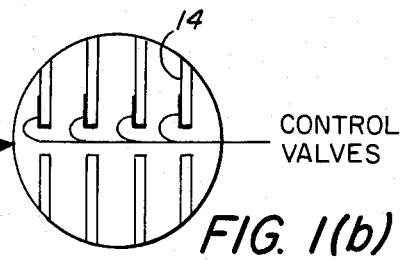

There is diagrammatically shown in FIG. 1 a pair of microchannel plates 10 and 12. As shown in FIG. 1(*a*) and FIG. 1(*b*), these have the axes-at-angles orientation taught in the above-mentioned Goodrich patent.

Each channel 14 of microchannel plate 10 is defined by wall 16, the lower portion 16*a* of which is of generally funnel-like shape. At the end of microchannel plate

10 toward microchannel plate 12 there are on wall 16 MCP electrode 18 and control electrode 20. The latter extends along the inside of the channel for the full height shown in, for example, FIG. 3(*a*) at 22, along only one line in channel axial cross-section. From its pointed extremity 22 it extends circumferentially and axially toward MCP 12, as indicated in dotted line 24 until terminating at the end of the channel at point 26, where two sloping lines 24 intersect. MCP electrode 18, outboard of control electrode 20, has a configuration generally similar to that of control electrode 20, tapering on both sides of a longitudinally longest length (up to 28) along lines (not shown) intersecting thereat to the upper extremity of shorter portion 30. (Although electrode 18 is shown outside the wall 16 in FIGS. 3(*a*) and (*b*), this is of course diagrammatic only.) Between the electrodes 18 and 20 is an insulating and rectifying layer 19, its latter characteristic being oriented to impede current flow when voltage is higher on control electrode 20. Metallic layer 18 is sputtered on MCP 10, layer 19 is sputtered thereon, and finally layer 20 is sputtered on. Layer 19 has a shape generally conforming to that of layer 20, and has a thickness of 10 microns, a resistivity in a direction toward the control electrode 20 inner surface of $10^{11}$ ohm-meters, and a dielectric constant of 5. The valve (gate) leakage current rate is about 2.5 picoamperes, and its R-C time constant is about 4.4 seconds. The surface area of valve electrode 20 is $10^{-9}$ square meters.

There are electrodes at the end of MCP 10 not shown and at both ends of MCP 12, all as known in the prior art.

OPERATION

In operation, four stages of operation may be sequenced.

First is what may be termed a "dark screen" stage, illustrated in FIGS. 3(*a*) and 4(*a*). As shown, in this state 1000 volts is applied to the outer electrode of microchannel plate 10, and minus 1000 volts to the outer electrode of MCP 12. Zero voltages are applied to the other electrodes. This causes electrons entering MCP 12 to be multiplied less than if the voltage drop thereacross were greater, and the zero voltage drop between MCP's means that the energy of the electrons emerging from MCP 12 are less than if the voltage at MCP 12 electrode near MCP 10 were reduced, as shown in FIG. 4(*b*). Accordingly, the total impact energy of electrons impinging on electrode 20 (E in FIG. 2) is less than that along line 40, whereat the secondary emission coefficient of control electrode 20 is one; this means that electrode 20 is then a net gainer of electrons, for it receives more than it emits, so that its voltage drops—to zero or slightly below. In this condition it diverts positive ions produced in MCP 10 in its portion relative to control electrode 20 away from MCP 12 and driven toward MCP 12 by the conventional longitudinal field as shown at arrow 42 so that said positive ions do not enter the channels of MCP 12 to produce under all the conditions a regenerative mode of operation.

When it is desired to go to a second stage, and "write", voltages are changed as shown in FIG. 4(*b*) in MCP 12, so that what had been minus 1000 becomes minus 1600 volts, and what had been zero volts becomes minus 100 volts. The former change, as above indicated, greatly increases the multiplication occuring in MCP 12, while the latter increases the energy of each electron falling on electrode 20 of MCP 10, so that now electrode 20 becomes a net loser of electrons (i.e., secondary-electron emissivity coefficient is now to the right of the vertical line marked "1" in FIG. 2), and its voltage rises, to about 25 volts. What happens is shown diagrammatically in FIG. 3(*b*): positive ions are now directed into the channels of MCP 12 owing to the positive voltage on electrode 20, so that under all the circumstances a self-sustaining condition arises in view of electrons' (generated by the ions, in MCP 12) thereupon flowing from MCP 12 into MCP 10. As is known, a microchannel plate may become self-sustaining (otherwise said, "regenerative") in various ways, including through increase of longitudinal field strength or channel length; in a self-sustaining mode there is a continued system output despite ending system input. This is also called in the art "turn-on"; and it has in general in the art been regarded as undesirable and to be avoided.

Figure 2:
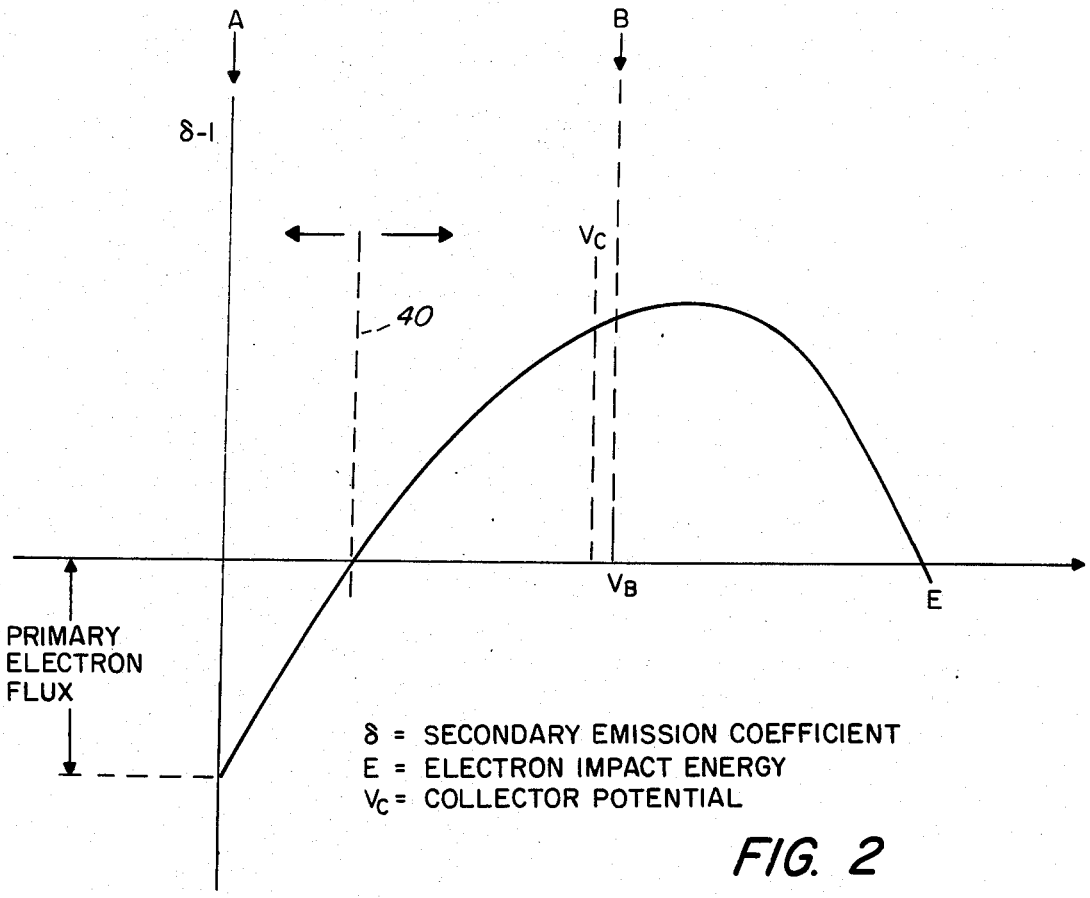
FIG. 2 is a graph of secondary emission coefficient (minus one) against electron impact energy.

The vertical lines labeled "A" and "B" in FIG. 2 are lines at which there is considerable stability, with lateral net charge transport between the valve 20 surface and the vacuum volume, so that the valve material requires slight electrical conductivity to the channel wall. In State A, the surface potential has fallen due to primary electron collection until the repelling potential difference prevents further electron collection; in State B, the surface potential has risen until it slightly exceeds the collector potential ($V_c$), at which level the small retarding potential ($V_B$–$V_C$) reduces the effective secondary emission coefficient close to unity by turning back the slower secondaries, and potential equilibrium is established.

When it is desired to simply maintain an image thus written, a "hold" stage may be entered. Here voltages are imposed as set forth in FIG. 4(*c*); these are the same as were used in the first stage, and because they leave on control electrode 20 the positive voltage of about 25, there is in effect frozen in place the image already written.

When it is desired to enter the fourth, or "erase", stage, voltages may be imposed as set forth in FIG. 4(*d*), with all of them at zero except that of MCP 12 away from MCP 10, which is at minus 1500 volts. Reduction of the wall ("collector", FIG. 2) voltage of MCP 10 to zero causes control electrode 20 to lose its positive voltage, so that the system resumes a mode of operation as in FIG. 3(*a*). The lower voltage minus 1500 degrees than used for the same electrode in the "dark" stage is to speed up erasure rate.

Making the layer 19 rectifying as specified, as by incorporating a pn junction, improves operation by preventing driving the control electrode 20 below ground voltage when the system is in a dark or erase mode of operation.

The dielectric layer 19 may suitably be of various materials, as a low alkali glass such as that known in the art as CGW 1724. Valve 20 may preferably suitably be a one-micron layer of silver-magnesium alloy, with the surface oxidized for enhanced secondary electron emission (constant about 5 for an impact voltage of 100). Insulating layer 19 need not necessarily be rectifying. In dark and erase modes it may be desirable to impose a slight negative voltage on the electrode of MCP 10 nearest MCP 12, to further reduce the energy of electrons impinging on control electrode 20.

Other embodiments are within the scope of the following claims.

I claim:

1. A device to write and store traces and image which comprises:

a first microchannel plate, a second microchannel plate, said plates having channels in series, and gating means to selectively affect feedback of ions from one said plate to the other said plate.

2. The device of claim 1 in which the axes of channels in one of said plates are not parallel to axes of channels of the other of said plates.

3. The device of claim 1 in which channels of one of said microchannel plates include selectively operable gates for affecting the flow of charged matter therethrough.

4. The device of claim 3 in which said gates are formed of secondarily electron emissive material and in which means are provided for selectively driving said material between electron emissivity coefficients of less than and greater than one.

5. The device of claim 4 in which one of said plates is arranged to deliver electrons to the other of said plates, and in which said gates are at the entrances of channels of said other plate from said one plate.

6. The device of claim 5 in which said materials extend partially only around the periphery of said entrances of said channels of said other.

7. The method of writing and storing traces which comprises introducing electrons at a first end of a first MCP, multiplying electrons in said first MCP, introducing electrons from said first MCP into a second MCP, generating a reverse flow of positive ions in said second MCP, and selectively switching flow of said positive ions into or away from channels of said first MCP.

8. The method of claim 7 in which said flow of positive ions is switched by means of an element of secondarily emissive material.

9. The method of claim 8 in which said MCP's have MCP electrodes at each end of each MCP, said MCP electrodes having imposed thereon voltages to selectively apply electrons to said secondarily emissive material, said electrons having sufficient energy to selectively give to said material an emissivity coefficient of less than one or greater than one.

10. The device of claim 4 in which said MCP has a microchannel wall, and material is spaced from a microchannel channel wall by a layer of material of lower resistance than the resistance of said material and said wall.

* * * * *